US005387909A

United States Patent [19]

Neel et al.

[11] Patent Number: 5,387,909

[45] Date of Patent: Feb. 7, 1995

[54] LAMP SENSING SYSTEM FOR TRAFFIC LIGHTS

[75] Inventors: Clyde J. Neel; Henry T. Beyer, both of Sugar Land, Tex.

[73] Assignee: Naztec, Inc., Sugar Land, Tex.

[21] Appl. No.: 36,718

[22] Filed: Mar. 25, 1993

[51] Int. Cl.[6] ..... G08G 1/097

[52] U.S. Cl. ..... 340/931; 315/130; 340/642; 340/953

[58] Field of Search ..... 340/931, 458, 953, 642; 315/130

[56] References Cited

U.S. PATENT DOCUMENTS

| | | | |
|---|---|---|---|
| 2,166,721 | 7/1939 | Jeffers . | |
| 3,715,741 | 2/1973 | McWade et al. | 340/642 |
| 4,295,079 | 10/1981 | Otsuka et al. | 340/642 |
| 4,396,868 | 8/1983 | Watanabe et al. | 340/642 |
| 4,811,010 | 3/1989 | Lucas | 340/931 |
| 5,034,659 | 7/1991 | Taniguchi | 340/642 |
| 5,235,317 | 8/1993 | Sutterlin et al. | 340/642 |
| 5,248,967 | 9/1993 | Daneshfar | 340/931 |

FOREIGN PATENT DOCUMENTS

| | | | |
|---|---|---|---|
| 3428444 | 2/1986 | Germany | 340/931 |
| 0710056 | 1/1980 | U.S.S.R. | 340/642 |

OTHER PUBLICATIONS

Published announcement of Traffic Sensor Corporation (at least as late as 1991).

Publication of the Sep./Oct., 1992 IMSA Journal, by Eric A. Metz, titled "Automatic Detection of Traffic Signal Lamp Outages".

Sales brochure of IMON Electronics, Inc. of Portland, Oreg., Dec. 1989.

Letter and brochure dated Apr., 1992 of Industrial Processor Controls Corp.

*Primary Examiner*—Brent Swarthout

*Attorney, Agent, or Firm*—Bush, Moseley & Riddle

[57] ABSTRACT

A method and apparatus for determining the presence of a burned out lamp of a traffic signal is disclosed. The current applied to one or more banks of traffic signals and the voltage applied across such traffic signal banks are measured simultaneously. An electrical characteristic, such as impedance, of such traffic signal banks, is measured for each pattern of switch settings which control lamp illumination for signalling as they occur. Such characteristic is stored for each of the unique patterns which are repeated over and over again to control traffic. Such previously stored characteristic provides a baseline characteristic for each successive pattern of illumination of the lamps. With each pattern change, such characteristic is measured and compared with the previous baseline characteristic for the pattern to determine if a lamp has burned out.

10 Claims, 4 Drawing Sheets

DIGITAL REPRESEN-TATION OF VOLTAGE V
TO COMPUTER 10
71
72
80
CLK
COUNTER
RST
70
CLK
COUNTER
RST
1 2 3 4
54
Q
Q̄
R
66
D
CLK
12V
65
Q
Q̄
R
64
D
CLK
1
VOLTAGE TO FREQUENCY CONVERTER
52
FULL WAVE RECTIFIER
50
62
SET TO ZERO
61
60
12V
CLOCK IN
R2
R1
T
30
V
FROM COMPUTER 10

TO COMPUTER 10
DIGITAL REPRESEN-TATION OF CURRENT I
180
CLK
COUNTER
RST
154
152
VOLTAGE TO FREQUENCY CONVERTER
150
FULL WAVE RECTIFIER
R3
L
I
24
170
CLK
COUNTER
RST
Q
Q̄
R
166
D
CLK
12V
164
Q
Q̄
R
D
CLK
162
SET TO ZERO
161
60
R
CLOCK IN
T
30
V
FROM COMPUTER 10

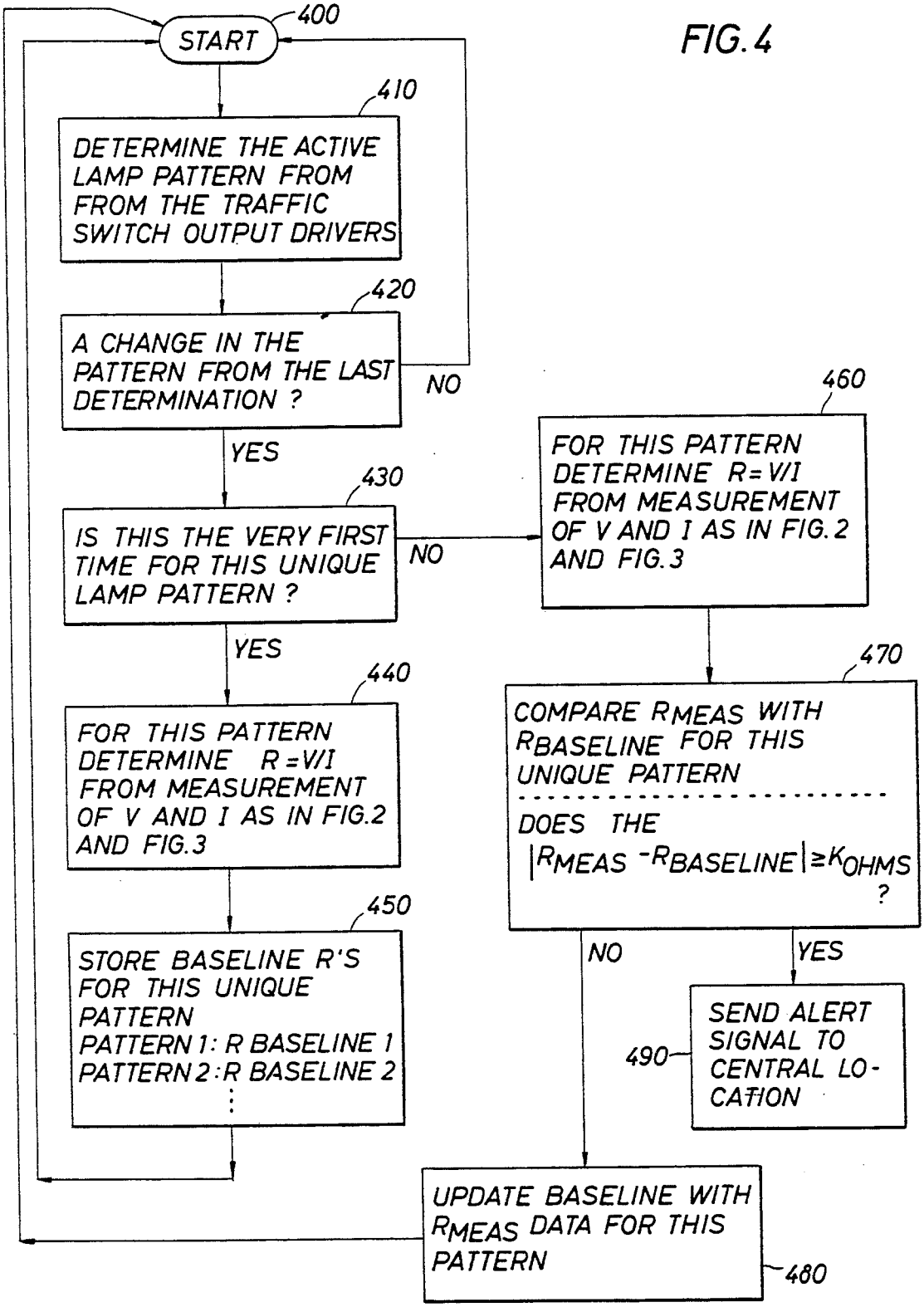
FIG. 4
START
400
410
DETERMINE THE ACTIVE LAMP PATTERN FROM FROM THE TRAFFIC SWITCH OUTPUT DRIVERS
420
A CHANGE IN THE PATTERN FROM THE LAST DETERMINATION ?
NO
YES
430
IS THIS THE VERY FIRST TIME FOR THIS UNIQUE LAMP PATTERN ?
NO
YES
440
FOR THIS PATTERN DETERMINE R=V/I FROM MEASUREMENT OF V AND I AS IN FIG.2 AND FIG.3
450
STORE BASELINE R'S FOR THIS UNIQUE PATTERN
PATTERN 1: R BASELINE 1
PATTERN 2: R BASELINE 2
460
FOR THIS PATTERN DETERMINE R=V/I FROM MEASUREMENT OF V AND I AS IN FIG.2 AND FIG.3
470
COMPARE RMEAS WITH RBASELINE FOR THIS UNIQUE PATTERN
DOES THE |RMEAS -RBASELINE| ≥KOHMS ?
NO
YES
490
SEND ALERT SIGNAL TO CENTRAL LOCATION
UPDATE BASELINE WITH RMEAS DATA FOR THIS PATTERN
480

LAMP SENSING SYSTEM FOR TRAFFIC LIGHTS

FIELD OF THE INVENTION

This invention relates to a lamp sensing system for traffic lights, and more particularly to such a lamp sensing system for determining if one or more lamps are burned out.

BACKGROUND OF THE INVENTION

As well known, traffic control lamps, or traffic signal banks (or simply "traffic signals") are provided for traffic control on streets and highways, especially at intersections. The traffic signals are cyclically displayed through a suitable timing and control mechanism. Such traffic control lamps are usually provided with green, red or amber lenses or sometimes with lenses having arrows to indicate direction.

Heretofore, such as shown in U.S. Pat. No. 2,166,721 dated Jul. 18, 1939, a traffic signal system has been provided to disconnect a traffic signal from regular operation if one of the lamps of the signal becomes burned out and to display either a steady or flashing light. As well known, when a lamp or bulb in the green, amber or red signal burns out, driver confusion may result because traffic on one street receives a green or go signal, and traffic on the other street receives no stop or red signal. Possible collisions are the result.

U.S. Pat. No. 4,135,145 dated Jan. 16, 1979 shows an error detecting circuit for a traffic control system which senses the operating status of a plurality of traffic signal lights controlled by a group of load switches which produce an error signal when certain predetermined conditions exist for more than a predetermined period of time. The error detection circuit provides a visual indication of the traffic signal lights and their associated load switches. A visual signal identifies the load switches and signal lights controlled by the switches in which one of the predetermined conditions exist. This patent does not show or disclose a detection system for sensing and detecting a burned out or inoperable traffic signal lamp.

U.S. Pat. No. 4,495,010 dated Jan. 15, 1985 discloses sensing apparatus that permits sensing of a change in a load condition so that the voltage level is increased immediately after additional lights are turned on in a fluorescent load bank. As a result there is no inconvenient delay and a predetermined threshold of voltage is maintained. Such patent is not directed to a traffic signal system.

It is an object of this invention to provide a lamp sensing system for traffic lights at an intersection for determining if one or more lamps are burned out or inoperable.

Another object of the invention is to provide such a lamp sensing system which makes a series of two measurements, one for the intersection voltage and another for the intersection current, and compares these measurements against an established predetermined pattern of operation of the lamps for the intersection in order to determine if a signal lamp is burned out or inoperable.

SUMMARY

The objects identified above as well as other features and advantages are achieved by a method and apparatus of the invention in which all traffic lamps of a traffic signal are monitored to determine if one or more of the lamps have burned out. Only two measuring variables are determined, one for intersection voltage, the other for intersection current.

Apparatus, including a microprocessor in the traffic controller (alternatively in the conflict monitor) determines a baseline electrical characteristic, such as impedance or resistance for each light pattern of the cycle of traffic signal patterns of the intersection. As the traffic signal light patterns are repeated, each new resistance value for a pattern is compared with the baseline resistance for that pattern. If the absolute difference in resistance of the current light pattern is greater than a predetermined resistance (in ohms) difference, a signal representative of that fact is stored and forwarded to a central traffic control computer center, where a traffic maintenance technician may be notified of the lamp condition at the intersection. By remote control, such technician may put the traffic controller and/or the conflict monitor at the intersection into a flash (failure) mode.

In the measurement of resistance for any pattern or "state" of the lamps lit at an intersection, the voltage and the current are measured simultaneously. In determining the baseline resistance for any particular lamp pattern, the voltage and current measurements are synchronized with the a.c. line voltage and are integrated for a multiple number of full cycles of the 60 cycle sinusoid of such a.c. line voltage. Such averaging is advantageous because it eliminates variations of current due to temperature gradients of the lamps.

BRIEF DESCRIPTION OF THE DRAWINGS

The objects, advantages and features of the invention will become more apparent by reference to the drawings which are appended hereto and wherein like numerals indicate like elements and wherein an illustrative embodiment of the invention is shown, of which:

FIG. 4 is a flow chart of the computer program used to control the measurement process for determination as to whether or not a bulb is burned out among lamps of a traffic intersection, where an increase in resistance is detected. A decrease in resistance is also monitored thereby providing identification of possible shorts occurring in the wiring or other unusual phenomenia of the bulbs of the traffic lights.

DESCRIPTION OF THE INVENTION

Figure 1:
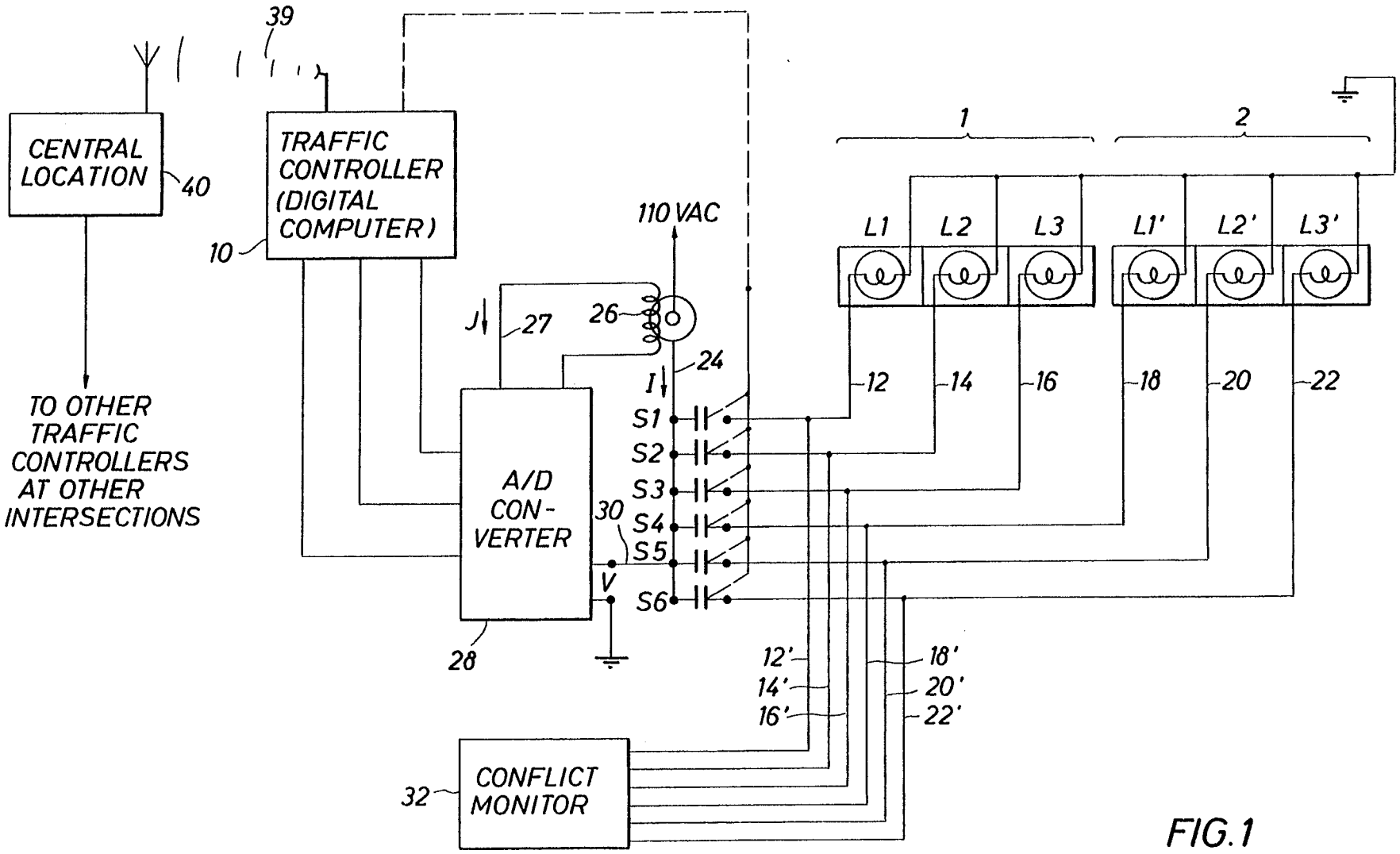
FIG. 1 is a block diagram, partly schematic, of a traffic system using the present invention.

Referring to FIG. 1, a block diagram is illustrated for two traffic light signal banks for an intersection utilizing the present invention. Such signal banks are connected in parallel across a 110 volt a.c. source for an illustrative description of the invention. Although only two signal banks 1, 2, are shown, the invention may be used with a single signal bank or three or more signal banks. In addition, signal banks may be repeated for redundancy at one direction of an intersection.

Green, red and amber lamps are provided respectively as lamps $L_1$, $L_2$, and $L_3$ for a first signal bank and as lamps $L_1'$, $L_2'$ and $L_3'$ for a second signal bank to control traffic at an intersection. Signal banks such as those illustrated in FIG. 1 are typically provided for each of four directions of an intersection of two streets.

A traffic controller 10 includes a microprocessor or digital computer including a stored computer program which provides a predetermined timed sequence to a series of semiconductor switches $S_1$, $S_2$, $S_3$, $S_4$, $S_5$, and $S_6$ for determining the on/off position of lamps $L_1$, $L_2$, $L_3$, $L_1'$, $L_2'$, and $L_3'$ as established in a predetermined pattern of operation. Leads 12, 14, and 16 extend between switches $S_1$, $S_2$, $S_3$ and lamps $L_1$, $L_2$ and $L_3$. Leads 18, 20 and 22 extend between switches $S_4$, $S_5$, $S_6$ and lamps $L_1'$, $L_2'$ and $L_3'$.

A 110 a.c. voltage source provides current I to lead 24 to lamps $L_1 \ldots L_3'$. Such current is measured by coil 26 provided about lead 24. The current J, proportional to the current I, as explained below, is rectified, and averaged for a predetermined number of sinusoidal cycles, and converted by an analog/digital converter 28 into a digital representation of the current I to traffic controller 10 which includes a programmed digital computer. The voltage V across lamps $L_1 \ldots L_3'$ is measured from line 30 with respect to ground, and as explained below, is rectified, averaged for a predetermined number of sinusoidal cycles, and converted into a digital signal by A/D converter 28 for traffic controller 10.

A conflict monitor 32 is connected to lamps $L_1 \ldots L_3'$ through lines 12', 14', 16', 18', 20', 22'. It functions, as well known in the art of traffic signal system design, to monitor any conflicting conditions such as a signal which results in intersecting traffic patterns proceeding simultaneously. One type of a conflicting condition is where two or more signal banks for intersecting roads simultaneously display green lights. When conflicting conditions occur, it is necessary to detect when the conflict occurs and to take appropriate action such as switching the system to a flashing mode of operation. The conflict monitor may include a microprocessor for this purpose. When the conflict monitor 32 contains a microprocessor, the software described below can be physically placed in the conflict monitor 32, instead of in the traffic controller.

In operation, the signal banks 1 and 2 are cycled through red, green and amber time segments as controlled by the conditions of switches $S_1 \ldots S_6$. For each combination of lighted lamps, the impedance of all the lamps is recorded. For example in Table I below, a "1" indicates that a lamp is lit; a "0" indicates that it is not. Pattern I represents a green or "go" condition. Pattern II represents an amber or "caution" condition. Pattern III represents a red or "stop" condition.

TABLE I

| Time | Pattern | $L_1$ | $L_2$ | $L_3$ | $L_1'$ | $L_2'$ | $L_3'$ | $Z = \frac{V}{I}$ |
|---|---|---|---|---|---|---|---|---|
| $t_1$ | I | 0 | 0 | 1 | 1 | 0 | 0 | $Z_1$ ohms |
| $t_2$ | II | 0 | 0 | 1 | 0 | 1 | 0 | $Z_2$ ohms |
| $t_3$ | III | 1 | 0 | 1 | 0 | 0 | 1 | $Z_3$ ohms |
| . | | | | | | | | |
| . | | | | | | | | |
| . | | | | | | | | |
| | | {light pattern and condition of switches} $S_1 \ldots S_6$ | | | | | | {impedance} |

The program logic of the computer stores the conditions of the switches. As time proceeds, the light patterns and the condition of switches $S_1 \ldots S_6$ repeat over and over again. Standard impedance values ($Z_{1,\,standard}$, $Z_{2,\,standard}$, $Z_{3,\,standard}$) for each pattern are determined from an average of a predetermined number of impedance determinations previously made. The impedance Z for each pattern as time proceeds is compared with the stored standard impedance for that pattern. If there is no substantial change, then a burned-out lamp signal is not generated. The standard impedance is constantly updated from the comparison readings so that long term variations in impedance are accounted for.

If one of the lamps burns out, the resistance for that light pattern of switches will change, (e.g.) as in Table II below:

TABLE II

| Time | Pattern | $L_1$ | $L_2$ | $L_3$ | $L_1'$ | $L_2'$ | $L_3'$ | $Z = \frac{V}{I}$ |
|---|---|---|---|---|---|---|---|---|
| | | | | . | | | | |
| | | | | . | | | | |
| | | | | . | | | | |
| $t_{1001}$ | I | 0 | 0 | 1 | 1 | 0 | 0 | $Z_1'$ ohms |
| $t_{1001}$ | II | 0 | 0 | 1 | 0 | 1 | 0 | $Z_2'$ ohms |
| $t_{1002}$ | III | 1 | 0 | 1 | 0 | 0 | 1 | $Z_3'$ ohms |
| | | {light pattern and condition of switches} $S_1 \ldots S_6$ | | | | | | {impedance} |

The traffic controller with its programmed digital computer 10 compares the impedance of the present light pattern with the standard impedance of such light patterns previously determined. For example at time $t_{1000}$ of Table II, the pattern I shows an impedance or "resistance" $Z_1'$. Resistance $Z_1'$ is compared to resistance $Z_{1,\,standard}$. If the difference between the two values is large enough, then an indicator is stored in the computer of the traffic controller 10 that a lamp has burned out. Such computer may be polled via a communication channel 39 to a central location 40 to determine whether or not the indicator is present which indicates that a lamp has burned out. A technician at the central location can direct a repair crew to the location of the traffic lights in order to replace the bulb.

Figure 2:
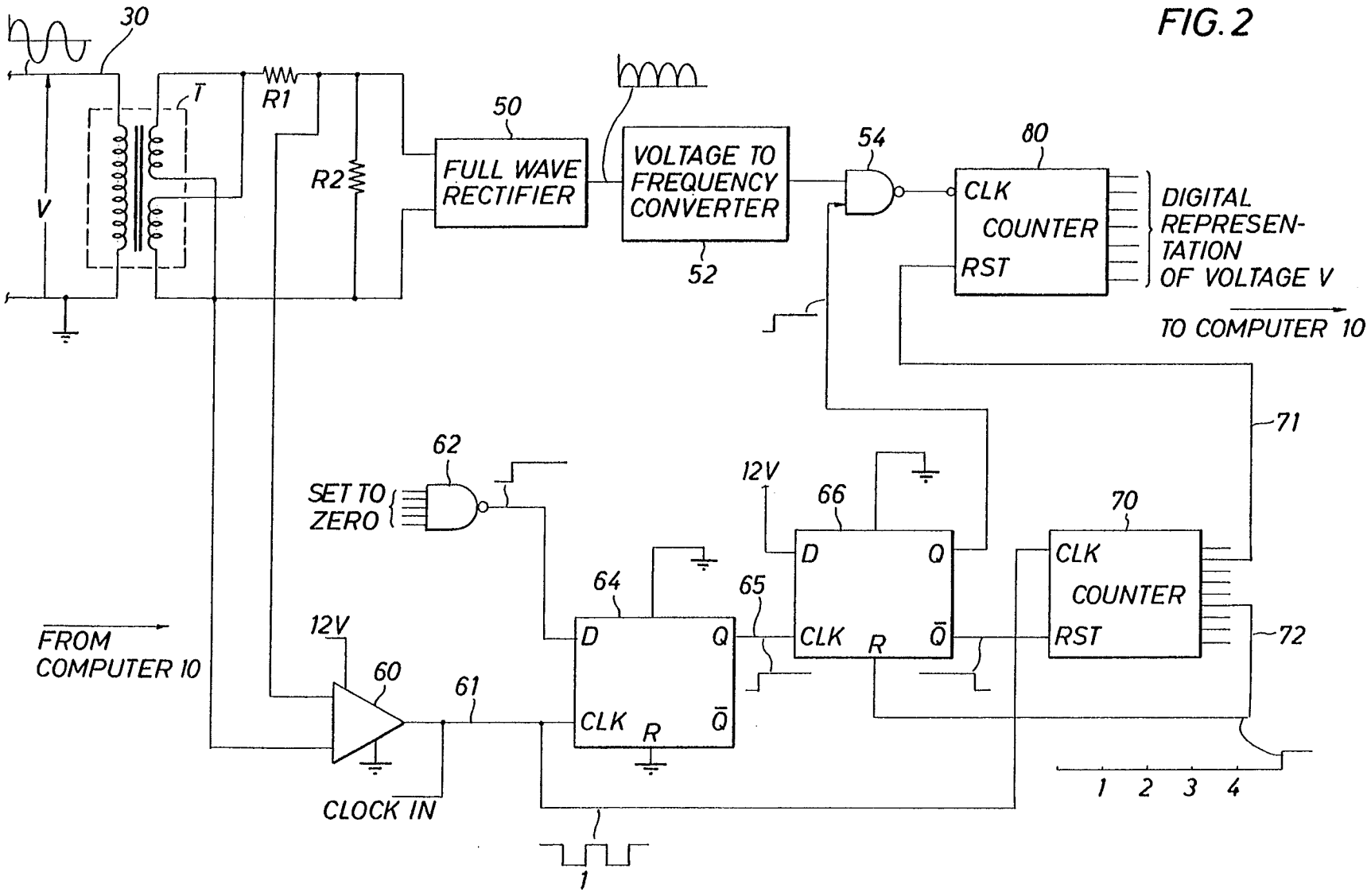
FIG. 2 is a schematic illustration of circuitry by which voltage measurements are synchronized with the zero crossing of the line signal and averaged during a predetermined number of cycles of the line voltage.

FIG. 2 is a schematic illustration of the preferred apparatus by which measurements of lamp voltage across lead 30 and ground are performed. The voltage V is applied to the input side of transformer T. At the output of transformer T the voltage V across lamps $L_1 \ldots L_3'$ (FIG. 1) is applied to full wave rectifier 50. The d.c. voltage from rectifier 50 is applied to a voltage to frequency converter 52 which produces an output square wave, the frequency of which is directly proportional to the d.c. level representative of the amplitude of the a.c. voltage V. The signal output of voltage to frequency converter 52 is applied to the clock input of counter 80 via AND gate 54.

The output of transformer T is also applied to operational amplifier 60 which produces a square wave output in synchronism with the a.c. voltage V. In other words, the square wave on lead 61 has zero crossings at the same time as the zero crossings of the sinusoidal wave of the a.c. voltage V. The square wave on lead 61 is applied to the clock input of flip-flop 64 and to the clock input of counter 70. The NOT AND (NAND) gate 62 is controlled from computer 10 by setting its input leads to a low or zero value. When that is done, a positive or "1" signal is output from the Q output on lead 65 and applied to the clock input of flip-flop 66. At that time, the Q output of flip-flop 66 is driven high or to a "1" (because a positive voltage is applied to its D input) and applied to AND gate 54 which enables the output of voltage to frequency converter 52 to be applied to the clock input of counter 80.

Simultaneously, the $\overline{Q}$ (not) output of flip-flop 66 is driven low or to a "0". Such "0" signal is applied to the reset input of counter 70 to remove the reset condition and allow it to count. The second positive going pulse square wave on lead 61 causes counter 70 to index. This results in lead 71 applying a "1" to the reset input of counter 80, clearing the counter. The next positive going pulse of the square wave on lead 61 indexes counter 70 and results in lead 71 applying a "0" to the reset of counter 80. Accordingly, counter 80 is allowed to count the number of rising edges of the signal output from voltage to frequency converter 52 so long as the Q output of flip-flop 66 is high and the output of counter 70 on lead 71 is low.

The counter 80 begins counting the pulses crossings of the signal proportional to voltage in synchronism with the zero crossing of the a.c. signal V applied across lead 30 and ground. Counter 70 begins counting the number of cycles of the a.c. voltage signal. When a predetermined number of cycles has been reached, for example 5, the output on lead 72 is driven high and is applied to the reset input R of flip-flop 66. Such reset signal drives the Q output of flip flop low which stops the signal via AND gate 54 to the clock input of counter 80. It also results in the $\overline{Q}$ of flip-flop 66 set to a "1" which resets counter 70. Accordingly, the output of counter 80 is a digital representation of the integrated voltage V as measured for a predetermined number of cycles of the a.c. voltage V.

The computer next sends "1" or high signals to NAND gate 62 which drives the D input low and the Q output low of flip-flop 64. The circuitry of FIG. 2 is again in its reset state awaiting a computer input to the input leads of NAND gate 62 for a new determination of an integrated voltage measurement.

Figure 3:
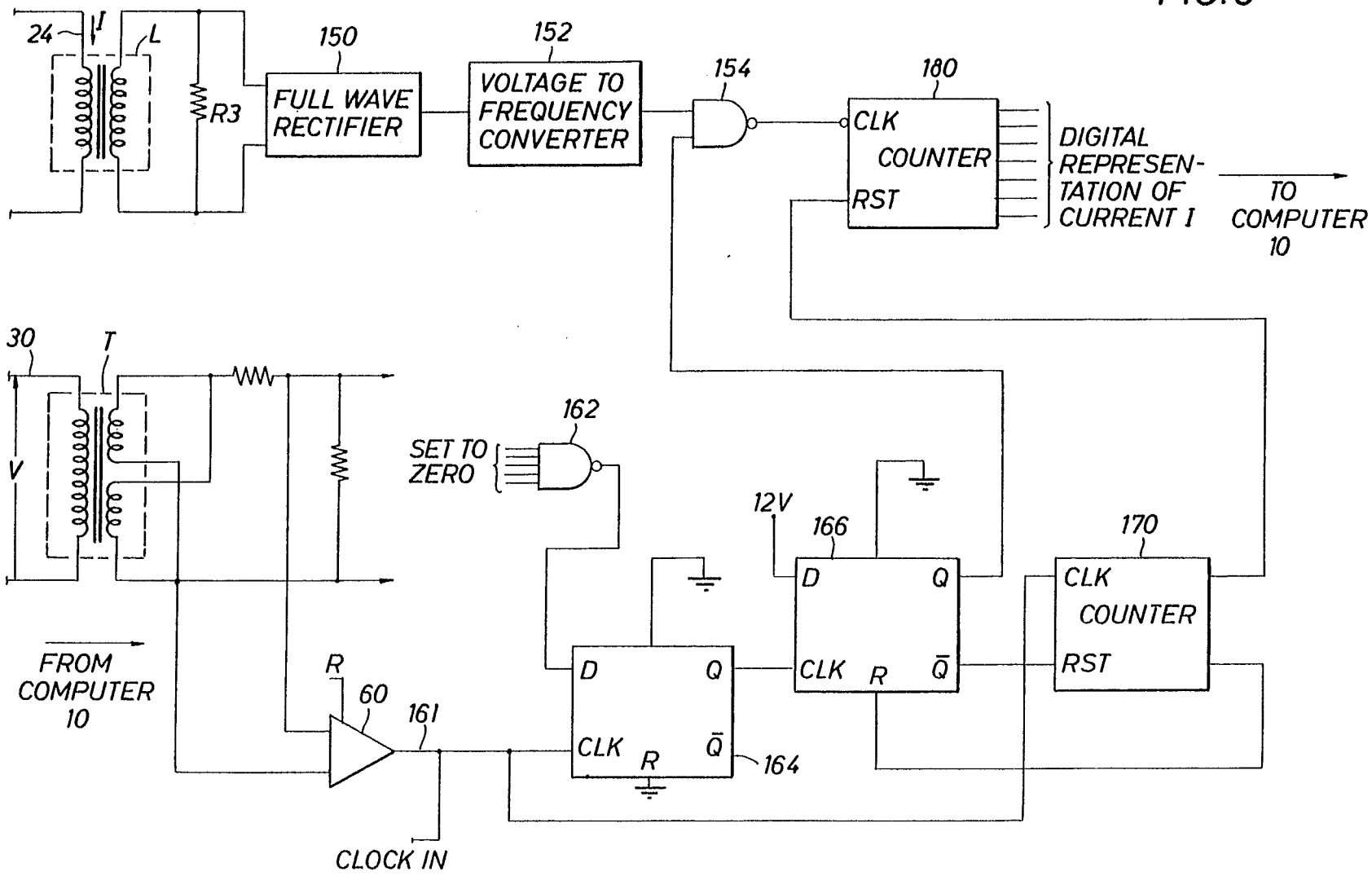
FIG. 3 is a schematic illustration of circuitry by which current measurements are synchronized with the zero crossing of the line signal and averaged during a predetermined number of cycles of the line voltage.

FIG. 3 illustrates the circuitry to obtain a digital representation of the current I applied to the lamps $L_1$. . . $L_3'$ during any pattern. The current signal I is applied across coil 26 to produce a voltage across parallel resister $R_3$. Such voltage, representative of current I, is rectified in rectifier 150, applied to voltage to frequency converter 152, and applied to counter 180 via AND gate 154 in a manner analogous to that described above with reference to FIG. 2 for the conversion of the voltage signal to a digital representation. The clock signal for synchronizing the count is obtained from operational amplifier 60 and the voltage signal V via transformer T. The circuit of FIG. 3 functions like that of FIG. 2 and need not be described in detail again. It generates at the output of counter 180 a digital representation of current averaged (or counted) for the identical number of cycles of the a.c. voltage or current. The control of such current determination is by the NAND gate 162 as described above which controls the circuitry of flip flops 164, 166, counter 170 and counter 180.

The circuitry of FIGS. 2 and 3 provide means, under control of programmed digital computer 10, for periodically determining digital representations of the voltage and current applied to the lamps $L_1$. . . $L_3'$ at a traffic intersection. The measurements for current I and voltage V are synchronized to the zero crossing of the 60 Hz line voltage and are integrated simultaneously for a predetermined number of full cycles, preferably 5 cycles. Such averaging avoids problems of variable instantaneous variations of current due to temperature variations in the lamps.

FIG. 4 is a flow chart representation of the computer program stored in the digital computer of the traffic controller 10 (or alternatively in conflict monitor 32). The computer begins with a start function 400 and proceeds to logic box 410. At 410, a determination is made of the lamp pattern output by the traffic controller 10. Box 420 is next and asks the question, Is this lamp pattern different from the last time we were in box 420? If the answer is yes, control is passed to box 430. If it is no, control is returned to the start. Logic box 430 then determines whether or not a very first pass is being made through the program for this unique lamp pattern after the program starts to run. If so, control is passed to logic box 440 where the characteristic R (e.g. V/I) is determined for the unique light pattern. Such determination is made by controlling the signals to NAND gate 62 of FIGS. 2 and 3. Next, in logic box 450, the resistance R determined for the pattern is stored as a baseline characteristic for this unique pattern. Control is then returned to the start logic box.

After a time period with the sequence of light patterns, control returns to box 430 in which the answer is that this unique lamp pattern has occurred before. The no answer passes control to logic box 460 to determine R (e.g. V/I) for this pattern as in box 440. Next, logic box 470 substracts the present R characteristic from the corresponding R of the stored baseline for the unique pattern. If the absolute value is greater than or equal to a predetermined value, e.g. K ohms, where K is a variable input of the computer program, then control is passed to logic box 490 for sending an alert signal to central location 40. Otherwise, logic control is passed to logic box 480 which updates the baseline value for the unique pattern with the present R characteristic determined in box 460. Control is then passed to start and then to logic box 410 where the program loops until the traffic controller outputs its next pattern of lights.

Various modifications and alterations in the described methods and apparatus will be apparent to those skilled in the art of the foregoing description which does not depart from the spirit of the invention. For this reason, these changes are desired to be included in the appended claims. The appended claims recite the only limitation to the present invention. The descriptive manner which is employed for setting forth the embodiments should be interpreted as illustrative but not limitative.

What is claimed is:

1. In combination with a traffic control system for a traffic intersection having a traffic controller for cyclically producing a plurality of patterns of command signals, a plurality of switches responsive to the command signals, and a plurality of traffic signal lamps each coupled to a lead from an a.c. voltage source via one of the switches for an on/off condition, apparatus for determining that one or more of the lamps have burned out comprising:

voltage measuring means connected to said a.c. voltage source for measuring the voltage across said signal lamps for each pattern of command signals applied to said switches;

current measuring means coupled to said a.c. voltage source for measuring total a.c. current applied to all of such signal lamps for each pattern of command signals applied to said switches simultaneously with the measurement of said voltage across said signal lamps;

computer means responsive to said current measuring means and to said voltage measuring means for determining a baseline electrical characteristic of said lamps for each pattern of command signals; and means responsive to said current measuring means and to said voltage measuring means for determining a present electrical characteristic of said lamps for each pattern of command signals and for comparing said present electrical characteristic for a pattern against said baseline characteristic of said pattern to determine if a difference exists between said present electrical characteristic and said baseline electrical characteristic of said pattern thereby to detect a burned out lamp.

2. The apparatus of the traffic control system of claim 1 wherein said voltage measuring means and said current measuring means are synchronized to the zero crossings of said a.c. voltage source.

3. The apparatus of the traffic control system of claim 2 wherein said voltage measuring means integrates said voltage across said signal lamps for each pattern of command signals for a predetermined number of oscillations of said a.c. voltage source, and said current measuring means integrates said current to said signal lamps for each pattern of command signals for said predetermined number of oscillations of said a.c. voltage source.

4. The apparatus of the traffic control system of claim 1 wherein said electrical characteristic is the ratio of said voltage across said signal lamps to said current applied to all of such signal lamps.

5. In a traffic control system for an intersection having a traffic controller for cyclically producing patterns of command signals, a plurality of switches responsive to the command signals, and a plurality of traffic signal lamps each coupled to a lead from an a.c. voltage source via one of the switches for an on/off condition; a method for determining that one or more of the lamps have burned out comprising the steps of measuring the voltage across said signal lamps for each pattern of said command signals applied to said switches;

measuring total current applied to all of such signal lamps for each pattern of said command signals applied to said switches simultaneously with the measurement of said voltage across said signal lamps;

determining a baseline electrical characteristic of said lamps from said measured voltage and said measured current for each pattern of command signals; and determining a present electrical characteristic of said lamps of each pattern of command signals; and comparing said present electrical characteristic of said lamps for a pattern of command signals against said baseline electrical characteristic Of said lamps of said pattern Of command signals to determine if a difference exists between said present electrical characteristic and said baseline electrical characteristic of said pattern thereby to detect a burned out lamp.

6. In combination with a traffic control system for controlling traffic at an intersection, the system having a plurality of signal lamps each of which is connected in parallel with an a.c. power lead through a switch associated with each signal lamp, and having a traffic controller means for controlling the operation of each of said switches so as to produce a timed sequence of control signals to said switches in order to produce a timed sequence of illumination patterns for such signal lamps, a lamp monitoring system including a voltage measuring circuit coupled to said a.c. power lead which produces a first signal proportional to the a.c. voltage across said signal lamps for each illumination pattern of said timed sequence of illumination patterns;

a single current sensor coupled to said a.c. power lead, a circuit connected to said single current sensor which produces a second signal proportional to a.c. current in said a.c. power lead for each illumination pattern of said timed sequence of illumination patterns, means for determining a present electrical characteristic of said lamps for each illuminated pattern, responsive to said first signal and said second signal, computer means responsive to said present electrical characteristic and for determining a baseline electrical characteristic of said lamps for each pattern and means responsive to said first and second signals for each of said illumination patterns for comparing said baseline electrical characteristic of said lamps for each pattern against the present electrical characteristic for each pattern, determining if a difference exists between said present electrical characteristic and said baseline electrical characteristic of said pattern for determining whether or not one or more of said lamps has burned out.

7. The combination of claim 6 wherein said a.c. power lead is connected to an unconditioned source of utility a.c. power.

8. The combination of claim 6 wherein said means responsive to said first and second signals includes means for determining a ratio of said first and second signals for each illumination pattern, means for storing said ratio for each pattern of said timed sequence of illumination patterns to create a baseline ratio for each illumination pattern of said illumination patterns;

means for determining for each illumination pattern if said ratio of said first and second signals is different from said baseline ratio for said illumination pattern by a predetermined amount, and means for generating an alert signal if said ratio of said first and second signals is different by said predetermined amount from said baseline ratio for any illumination pattern.

9. The combination of claim 8 further comprising means for updating said baseline ratio for each illumination pattern if said ratio of said first and second signal is not different by said predetermined amount, whereby said baseline of ratios for each illumination pattern are adjusted due to slow changes in characteristics of said lamps due to temperature.

10. The combination of claim 6 wherein said voltage measuring circuit and said current measuring circuit respectively simultaneously and synchronously generate said first and second signals for said each illumination pattern over a period of sinusoidal cycles of the a.c. voltage of said a.c. power lead.

* * * * *